United States Patent [19]

Treiman

[11] 4,185,768

[45] Jan. 29, 1980

[54] GARMENT HANGER HAVING LATCH TO PREVENT SWIVELING

[76] Inventor: Alfred A. Treiman, 1519 Easterly Ter ., Los Angeles, Calif. 90026

[21] Appl. No.: 947,839

[22] Filed: Oct. 2, 1978

[51] Int. Cl.[2] ..... A47J 51/098

[52] U.S. Cl. ..... 223/85

[58] Field of Search ..... 223/85, 88, 92; 206/289, 290, 291, 300; 248/561, 562, 339; 211/113, 115

[56] References Cited

U.S. PATENT DOCUMENTS

| | | | |
|---|---|---|---|
| 2,460,438 | 1/1949 | Treiman | 223/92 |
| 3,069,054 | 12/1962 | Treiman | 223/92 |
| 3,191,770 | 6/1965 | Zuckerman | 223/85 X |
| 4,074,838 | 2/1978 | Blasnik et al. | 223/85 |

*Primary Examiner*—George H. Krizmanich

[57] ABSTRACT

A garment hanger is convertible from a fixed-hook shipping and storage hanger to a swiveling display hanger; it has a hook member which extends downward through a central suspension bore in the hanger body; a flattened and widened portion of the hook shaft is engaged within a window opening through the hanger body central suspension portion to rotatably suspend the hanger body for display of garments. For shipping and storage, the hook is prevented from rotating relative to the hanger body by a latch member. A vertically slidable latch member having an inner slot, which may receive and engage the flattened portion, is slided upward to restrain the hook from swiveling.

6 Claims, 4 Drawing Figures

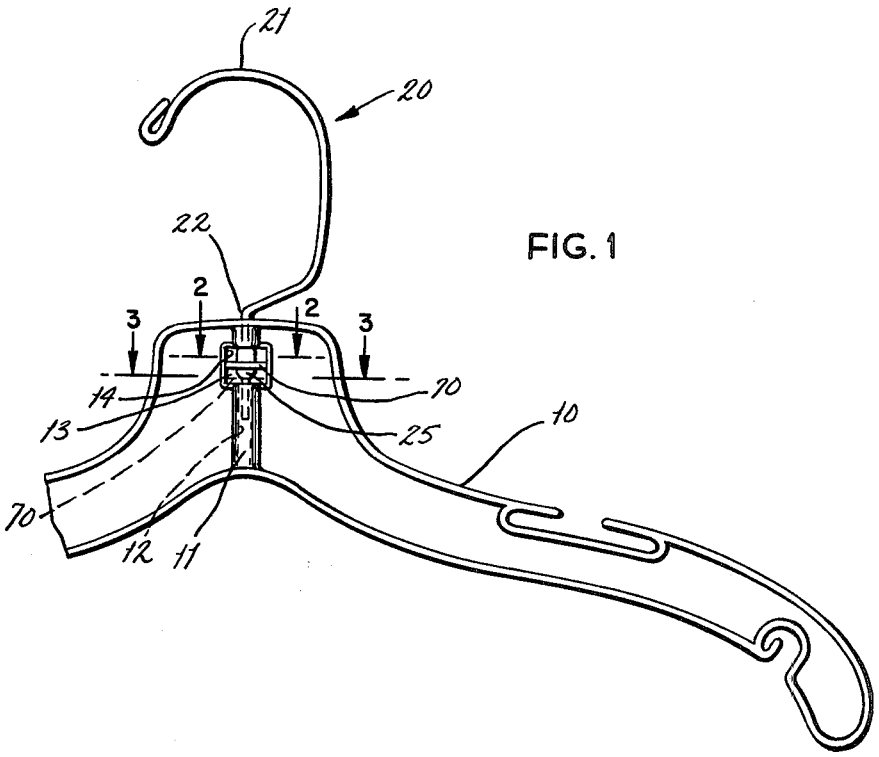
FIG. 1
FIG. 2
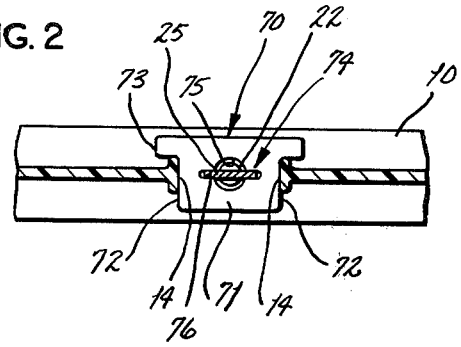
FIG. 4
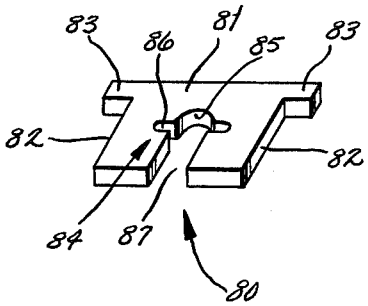
FIG. 3
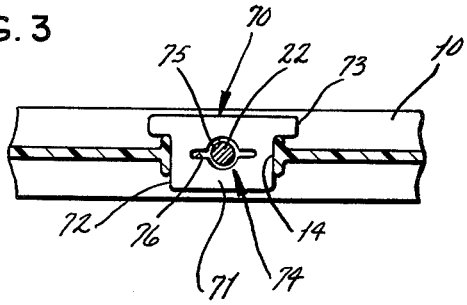

GARMENT HANGER HAVING LATCH TO PREVENT SWIVELING

BACKGROUND OF THE INVENTION

The present invention relates to garment hangers, and more specifically to a garment hanger whose hook may alternately be fixed or swiveling, as desired.

For shipping and storage, clothing suppliers prefer to utilize hangers for which the hook is maintained fixed in position with respect to the hanger body. Retailers, instead, prefer to display their clothing on hangers which have swiveling hooks, for shopper convenience. When the retailer receives from the supplier clothing on nonswiveling hangers, he must transfer each item to a swiveling hanger before placing it on a rack for sale.

U.S. Pat. No. 4,074,838 to Blasnik, et al., discloses an intricate garment hanger requiring special molding techniques. A cored channel in the hanger receives a hook, which is axially displaceable between a fixed position and a swiveling position. The tooling required to achieve this result is expensive and may result in lessened strength of the hanger.

SUMMARY OF THE INVENTION

An object of the present invention is to provide a simple garment hanger construction for which the hook may alternately be either fixed or swiveling with respect to the hanger body. Another object is to provide means whereby a swiveling garment hanger may be converted to a nonswiveling hanger. Other objects will be apparent from the disclosure which follows.

Briefly summarizing, the present garment hanger is of the type whose hanger body has a central suspension portion including a vertical bore and a window-like opening into which the bore extends, the window-like opening having side walls spaced outward of the vertical bore. The hanger further comprises a hook member whose shaft portion extends downward through the vertical bore, the shaft portion having a flattened and widened portion at the level of the hanger body window-like opening, to suspend the hanger body from the shaft. In a hanger in which the flattened portion of the hook shaft is in the same plane as that of the hook, a vertically slidable latch member may be slided to engage, by a vertical slot, the hook flattened portion to prevent swiveling when the hook is in the plane of the hanger.

BRIEF DESCRIPTION OF THE DRAWINGS

FIG. 1 is a side view of a garment hanger for which the flattened portion of the hook shaft is parallel to the plane of the hook. A vertically slidable latch member is shown in an upper latched position in solid lines and in a lower unlatched position in phantom lines.

FIG. 2 is an enlarged horizontal section taken along line 2—2 of FIG. 1, showing the flattened portion of the hook shaft engaged in a slot in the latch member to prevent swiveling.

FIG. 3 is an enlarged horizontal section taken along line 3—3 of FIG. 1, showing the latch member in the position shown in phantom lines in FIG. 1, in which the hook is free to swivel.

FIG. 4 is an oblique view of an alternate vertically slidable latch member which may be horizontally removed.

DESCRIPTION OF THE PREFERRED EMBODIMENT

For the preferred embodiments, a typical swiveling display garment hanger, shown in FIG. 1, has a hard plastic hanger body 10 which extends outward substantially in a plane from a vertical tubular central suspension portion 11, which has a vertical bore 12 extending downward therein. The central suspension portion 11 is interrupted at a level between its upper and lower ends by a preferably rectangular window opening 13 which extends therethrough substantially perpendicular to the plane of the hanger body 10. The window opening 13 has substantially vertical side walls 14 spaced outward of the bore 12.

The garment hanger has a hook member, generally designated 20, comprised of a curved upper hook portion 21 lying in a vertical plane and a lower cylindrical shaft portion 22 extending downward into the vertical bore 12 of the hanger body 10. The lower cylindrical shaft portion 22 has, at the level of the hanger window opening 13, a flattened and widened detent portion 25, which extends radially outward an amount greater than the radius of the vertical bore 12 to support the hanger body 10 suspended from the hook member 20. The flattened and widened detent portion 25 is parallel to the plane of the upper hook portion 21. The overall vertical height of the flattened portion 25 is less than the vertical height of the hanger body window opening 13.

For use with this garment hanger, a first vertically slidable latch member, generally designated 70, as shown in FIGS. 1–3, has a latch body 71 of a thickness approximately equal to or less than the difference between the vertical height of the hanger window opening 13 and the height of the hook shaft flattened portion 25. The latch body 71 has a pair of opposed outer surfaces 72 of such separation as to be matable within the side walls 14 of the window opening 13; shoulders 73 extend outward from these side walls 14 at one side of the body 71. The body 71 has a substantially centrally located vertical passage, generally designated 74, therethrough, having an aperture, circular arc or bushing portion 75 of sufficient size and radius to accept the hook lower shaft portion 22. Extending radially outward of the extremeties of the arc portion 75 is a pair of opposed vertical slot portions 76 of such length and breadth to accept and engage snugly the hook shaft flattened portion 25.

This latch member 70 may be constructed of metal stock, by piercing, extruding or other conventional processes; after its completion, it is installed onto the hook shaft 22. This installation is done during the insertion of the hook shaft 22 into the hanger vertical bore 12 and prior to making the flattened portion 25 of the shaft 22, such as by striking the shaft 22 laid on an anvil.

A second vertically slidable latch member, shown in FIG. 4 and generally designated 80, is similar in most respects to the above described vertically slidable latch member 70 as shown in FIGS 1–3. The latch body 81 likewise has a pair of opposed outer surfaces 82, matable with the hanger body window opening side walls 14 and a pair of opposed shoulders 83 extending outward from the outer surfaces 82; a substantially centrally located vertical passage 84 extends through the latch body 81 and has an aperture portion which preferably is a circular arc or bushing portion 85 from which extends a pair of opposed vertical slots 86 of such size to accept and engage the hook flattened portion 25. This second latch member 80 differs in that its vertical passage 84 includes a passage opening or entranceway 87 which extends vertically through the latch member 80 and from the circular arc portion 85 to the side of the latch member opposite the shoulders 83, substantially perpendicular to the opposed outer surfaces 82 and transverse to the passage opening 87. The passage opening 87 is of sufficient width to accept the hook member lower shaft portion 22.

In use of the garment hanger 10 with the first latch member 70 of the two described above, when it is not desired to prevent the hook 20 from swiveling, the latch member 70 is slided downward to rest on the lower side of the hanger body window opening 13, as shown in phantom lines in FIG. 1. The shaft flattened portion 25 is upward, abutting the upper side of the body opening 13, because the hanger 10 is suspended therefrom; thus, only the hook shaft 22 and not its flattened portion 25 is within the latch member vertical passage 74 and the hook 20 is free to swivel. By sliding the latch member 70 upward until its slots 76 snugly engage the hook shaft flattened portion 25, the hook 20 is prevented from swiveling.

The second latch 80 is used in much the same manner, except that it may be removed from the window opening 13 by its passage opening 87 when slided downward. Installation need not be done prior to making the flattened portion of the hook shaft 22.

From the above disclosure, persons skilled in the art may modify the present invention as described in the above embodiments by combining or making obvious modifications to those features described. For example, the shaft portion of the hook member may have detent means of any non-circular shape which will accept a vertically slidable latch member; and the means to suspend the hanger body from the hook may be some element other than the detent portion of the hook. As an example, for a vertically slidable latch, a flattened detent portion on the hook shaft may be in any vertical plane; the latch member would have its slots extending in that same plane. The latch member may be of any shape which permits latching and unlatching, as the shape of the detent and opening may require. Other modifications in shape will be dictated by the materials utilized, whether plastic, rubber, wood or metal. Such modifications will from this disclosure be apparent to persons skilled in the art.

I claim:

1. For use with a garment hanger of the type including a hanger body extending substantially in a plane from a central suspension portion having a vertical bore extending downward therein, and having a window opening through said suspension portion into which said vertical bore extends, said window opening having side walls, and further of the type including a hook member having an upper hook portion in a vertical plane, a lower shaft portion secured rotatingly in the central suspension vertical bore of said hanger body, and detent means of non-circular cross-section provided in said hook member shaft portion at the level of said window opening, the detent means being of substantially less vertical height than the height of the window opening.

a latch member for converting such garment hanger from a swiveling display hanger to a fixed-hook storage hanger, said latch member being of a vertical height which does not exceed the difference in height between that of such hanger body window opening and that of such detent means, and having a substantially constant horizontal cross-section throughout its vertical height, and comprising a pair of opposed outer surfaces matable within the side walls of such hanger body window opening, and means, non-circular in cross-section and spaced substantially midway between said opposed outer surfaces, to accommodate said hook member shaft portion adjacent to its non-circular detent means and upon vertical sliding of the latch member to engage the detent means of such hook member when its upper hook portion is in the plane of the hanger body, whereby the interengagement by the latch member of such detent means and such hanger window opening side walls prevents such hook member from swiveling relative to such hanger body.

2. For use with a garment hanger of the type specified in Claim 1 and in which the non-circular detent means of its hook member is flattened, a latch member as defined in claim 1 characterized in that said latch member means non-circular in cross-section comprises a vertical passage having an aperture portion having a passage opening therein parallel to said opposed outer surfaces, both said aperture portion and said passage opening being of such size as to accept the shaft portion of such hook member, and a slot portion therein, said slot portion being transverse to said opening of such length and width as to accept the flattened detent portion of such hook member, whereby said latch member may be inserted and removed from the hanger body window opening below the detent means.

3. A garment hanger including a hanger body member extending substantially in a plane from a central suspension portion which includes a vertical bore extending downward therein and a window opening through the suspension portion into which the vertical bore extends, the window opening having side walls spaced outward from the vertical bore, and further including a hook member having an upper hook portion in a vertical plane and a lower cylindrical shaft portion engaged and rotatable within the vertical bore of the hanger body suspension portion, the shaft portion having, at the level of the window opening, detent means substantially less in vertical height than the height of said window opening and extending radially an amount greater than the radius of the vertical bore, whereby to support the hanger body when suspended in the hook member, in combination with a vertically slidable latch member having a pair of opposed outer surfaces matable with the side walls of the hanger body window opening, a vertical passage therethrough spaced between said opposed outer surfaces, including a bushing portion of such size as to accept the hook member shaft portion, and a vertical slot portion, extending radially outward of said bushing portion to engage the detent means of the hook shaft portion when the hook portion is in the plane of the hanger body, whereby said latch member may be so slided vertically in the window opening to engage the hook detent means in its said slot means and resist rotation by the mating of its said outer surfaces with the hanger body side walls, or may be so slided vertically such that the hook detent means are not engaged in said slot means and the hook is free to rotate relative to the hanger body in said bushing portion.

4. The garment hanger latch member as defined in claim 3, in which the garment hanger hook shaft detent means extends radially substantially in the plane of the hook, and wherein the latch member vertical slot portion lies substantially perpendicular to the latch member opposed outer surfaces.

5. The garment hanger latch member as defined in claim 3, wherein said vertically slidable latch member has, extending outward from its opposed outer surfaces, shoulder means to abut the hanger central suspension portion outward of the window opening side walls.

6. The garment hanger as defined in claim 5, wherein said latch member vertical passage further has a passage opening extending substantially parallel to said opposed outer surfaces, from said bushing portion to end at that side of said latch member opposite said shoulder means, said passage opening being of sufficient width to accept the hook member lower shaft portion, whereby said latch member may be inserted and removed from the hanger body window opening below the detent means.

* * * * *